US007077816B2

(12) United States Patent
Tseng

(10) Patent No.: US 7,077,816 B2
(45) Date of Patent: Jul. 18, 2006

(54) KNEADING MASSAGER

(76) Inventor: Chin-Chun Tseng, No. 13, Lane 380, Sec. 2, Chung-Shan Rd., Chung-Ho, Taipei (TW)

( * ) Notice: Subject to any disclaimer, the term of this patent is extended or adjusted under 35 U.S.C. 154(b) by 7 days.

(21) Appl. No.: 11/034,814

(22) Filed: Jan. 14, 2005

(65) Prior Publication Data

US 2005/0124921 A1 Jun. 9, 2005

Related U.S. Application Data

(63) Continuation-in-part of application No. 10/306,219, filed on Nov. 29, 2002, now abandoned.

(51) Int. Cl.
*A61H 7/00* (2006.01)

(52) U.S. Cl. ..... 601/86; 601/87; 601/112; 601/134

(58) Field of Classification Search ..... 601/84, 601/86, 87, 89, 90, 93–95, 97, 98, 100, 101, 601/103, 104, 107, 108, 110–112, 116, 126, 601/133, 134
See application file for complete search history.

(56) References Cited

U.S. PATENT DOCUMENTS

| | | | | |
|---|---|---|---|---|
| 5,685,827 | A * | 11/1997 | Shimizu | 601/87 |
| 5,711,758 | A * | 1/1998 | Tseng | 601/127 |
| 6,979,302 | B1 * | 12/2005 | Chen | 601/87 |
| 2003/0009117 | A1 * | 1/2003 | Zou | 601/134 |

* cited by examiner

*Primary Examiner*—Quang D. Thanh
(74) *Attorney, Agent, or Firm*—Rosenberg, Klein & Lee

(57) ABSTRACT

A kneading massager has a speed reduction gear unit in mesh with the output shaft of a direct current (DC) driving motor to input the mechanical power of the motor, the speed reduction gear unit has several output shafts to engage with a tapered massage block thereby making the massage block to provide gentle and comfortable kneading motion like human fingers when being driven by the DC motor.

2 Claims, 6 Drawing Sheets

KNEADING MASSAGER

CROSS-REFERENCES TO RELATED APPLICATIONS

The present invention is a Continuation-in-part (CIP) application of a non-provisional patent application with application No. 10/306,219 filed 29 Nov. 2002, now abandoned.

BACKGROUND OF THE INVENTION

1. Field of the Invention

The present invention relates to a kneading massager, and particularly, to a light, thin and small sized kneading massager capable of relaxing the user's muscle.

2. Description of the Prior Art

As for the conventional massage chair, please refer to the it mainly includes the following components: a base plate that has a top forming a rail level and a set block provided respectively at both ends of the plate; each of the set blocks has a hinge hole and a screw bolt whose two ends being hinged to the hinge holes, the one end thereof is connected to a power source so that the screw bolt is able to rotate between the two set blocks; a sliding seat with a hollow seat body capable of sliding on the rail level of the base plate and having a drilled hole horizontally passing through it, a screw bolt can be screwed into the drilled holes from two sides; two massage wheels that respectively include a power output shaft passing through the drilled hole of the sliding seat, a transmission gear in mesh with the screw bolt, and a contact roller emerged out of the sliding seat, the one end of the output shaft connected with the transmission gear and the other end with the contact roller.

Of course the above mentioned device is functional as a massager. However, employing an AC motor as its power source causes its overall structure heavy and bulky. Besides, massaging the body with contact rollers can hardly bring a comfortable feeling to the user, on the contrary, the user will feel painful on the back after the contact roller rolling on the back up and down for a long time. An improvement is seriously necessary.

The inventor has dedicated great efforts for years to studying and improving these defects and come up with a novel kneading massager as provided in this invention to eliminate the defects mentioned above.

SUMMARY OF THE INVENTION

The main object of the present invention is to provide a kneading massager driven by a light and small sized direct current (DC) motor to move inwardly and outwardly a massage block of the massager so as to achieve a kneading massage effect.

Another object of the present invention is to provide a light and small kneading massager which can be easily fabricated and assembled with low cost.

Still another object of the present invention is to provide a kneading massager which is applicable to a movable massage cushion, a massage bed, a massage chair, an office chair, an automobile seat and an easy chair.

To achieve these and other objects described above, the kneading massager provided by the present invention is composed of a speed reduction gear unit, a DC driving motor, and a massage block. The speed reduction gear unit is engaged with a transmission gear at its bottom for receiving the mechanical power to the unit, several output shafts are emerged from the top surface of the speed reduction gear unit each of which has a metal washer fitted to it by disposing on the top surface of the unit thereof. The DC motor is coupled to a worm gear with its output shaft, the Dc motor is disposed beneath the speed reduction gear unit such that the worm gear can be in mesh with the transmission gear at the bottom of the speed reduction gear unit. The massage block further includes a main body and a bottom cover, the main body has a hole at its bottom, while the bottom cover is provided with several confinement holes around its edge, and each hole has a ball in it, the bottom cover is engaged with the bottom of the main body with its center hole aligned to the bottom hole of the main body and a metal pad is sandwiched therebetween such that the balls arrayed around the edge of the bottom cover are in contact with the metal pad. These balls will be easily rotatable by contacting the metal washers disposed on the top surface of the speed reduction gear unit and thus facilitate motion of the massage block when the message block is engaged with the output shaft of the speed reduction gear unit. With this structure, when the DC motor rotates, the mechanical power is transmitted to the massage block via the worm gear, coupled with its output shaft, the transmission gear, the speed reduction gear unit, in order thereby the massage block is driven by the output shaft of the speed reduction gear unit to perform kneading motion inwardly or outwardly like human fingers.

These features and advantages of the present invention will be fully understood and appreciated from the following detailed description of the accompanying Drawings.

DETAILED DESCRIPTION OF THE PREFERRED EMBODIMENT

Figure 1:
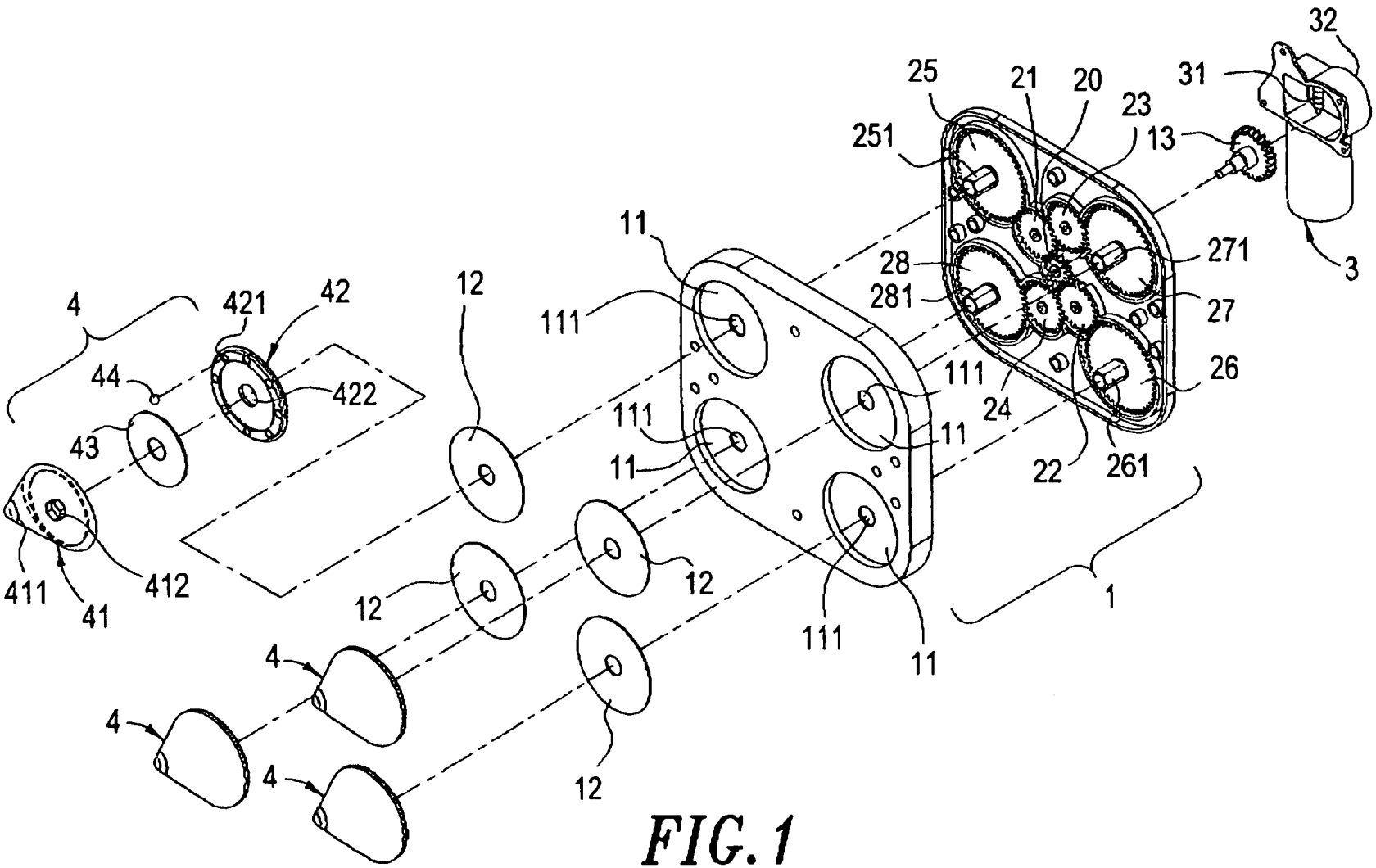
FIG. 1 is an exploded schematic view of the kneading massager according to the present invention.
Figure 2A:
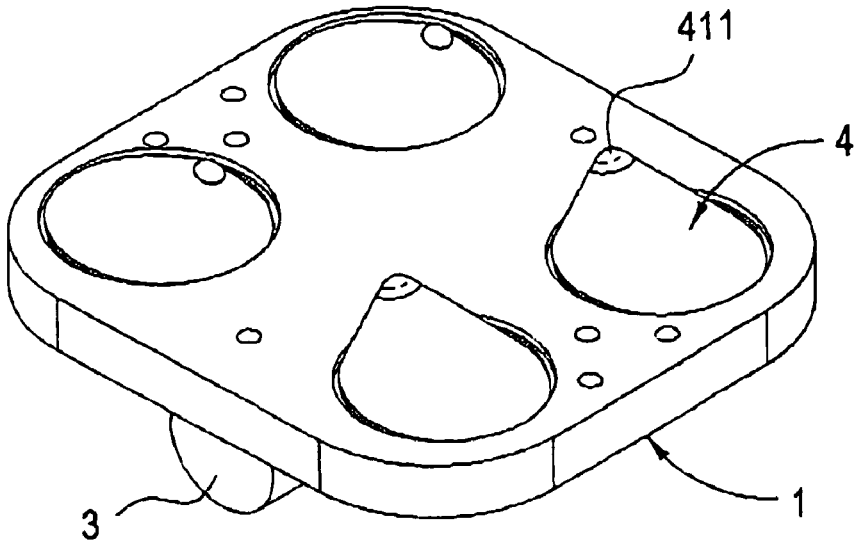
FIG. 2A and FIG. 2B are respectively the three dimensional front and back views of the kneading massager according to the present invention.
Figure 2B:
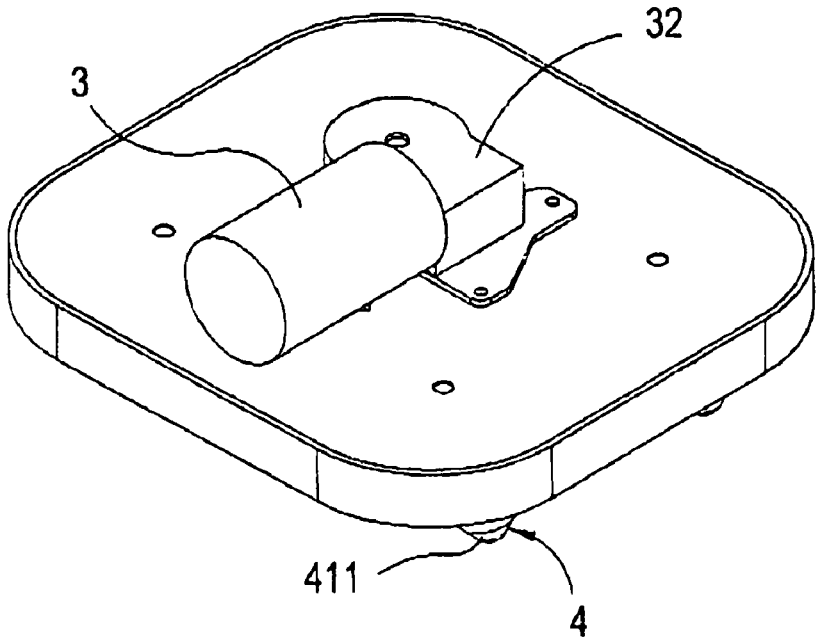

Referring to FIGS. 1, 2A and 2B simultaneously, the kneading massager of the present invention comprises a speed reduction gear unit 1, a DC motor 3, and a massage block 4. The speed reduction gear unit further includes a driver gear 20 and eight follower gears 21–28. The driver gear 20 is in mesh with the first and second follower gears 21, 22, whereas the first follower gear 21 is further in mesh with the third and fifth follower gears 23 and 25. The second follower gear 22 is in mesh with the fourth and sixth follower gears 24 and 26, whereas the seventh and eighth follower gears 27 and 28 are respectively in mesh with the third and fourth follower gears 23 and 24. As for the gear size the fifth to eighth follower gears 25–28 are the largest, while the first to fourth follower gears 21-24 rank to the next larger size, the driver gear 20 is the smallest. With such arrangement, the aforesaid gears are combined to form the speed reduction gear unit 1. The fifth to eight follower gears 25–28 are respectively equipped with output shafts 251, 261, 271 and 281. The speed reduction gear unit 1 has four recessed portions 11 formed on its top surface each having a hole 111 for output shafts 251, 261, 271, 281 to pass through. A metal washer 12 is provided for each of the holes 11 in the way that it is fitted onto each of the output shafts 251, 261, 271 and 281. A transmission gear 13 installed beneath the speed reduction gear unit 1 is in mesh with the driver gear 20.

The DC motor 3 has a worm gear 31 engaged with its output shaft. The worm gear 31 is accommodated in a bottom cover 32 which is fixed to the bottom of the speed reduction gear unit 1 so as to enclose the transmission gear 13. By coupling the worm gear 31 to the transmission gear 13, the mechanical output of the DC motor 3 can be outputted from the output shafts 251, 261, 271, and 281 with amplified rotating torque and reduced rotational speed through the speed reduction gear unit 1.

The massage block 4 further includes a main body 41 and a bottom cover 42. The main body 41, approximately in a tapered shape, may be equipped with an extra movable block 411 on its top, and provided with a hole 412 on its bottom. The bottom cover 42 has several confinement holes 421 formed along its edge with a ball 44 confined in each hole 421 in the manner that each ball 44 is emerged from the bottom surface of the bottom cover 42. The bottom cover 42 is engaged with the main body 41 from its bottom by aligning the center hole 422 of the bottom cover 42 to the hole 412 and sandwiches a metal pad 43 between the main body 41 and the bottom cover 42 such that the balls 44 arranged around the edge of the bottom cover 42 are mated with the metal pad 43, and then the massage block 4 is inserted into the output shafts 251, 261, 271, and 281 so as to install the bottom cover 42 on the recessed portion s 11 formed on the top surface of the speed reduction gear unit 1 thereby bringing those balls 44 emerged down from the bottom cover 42 to contact their corresponding metal washer 12 in the recessed portion 11. By so the balls 44 are made easy to roll that in turn facilitate the motion of the massage block 4 and avoid abrasion of the massage block 4 and the speed reduction gear unit 1.

Figure 3B:
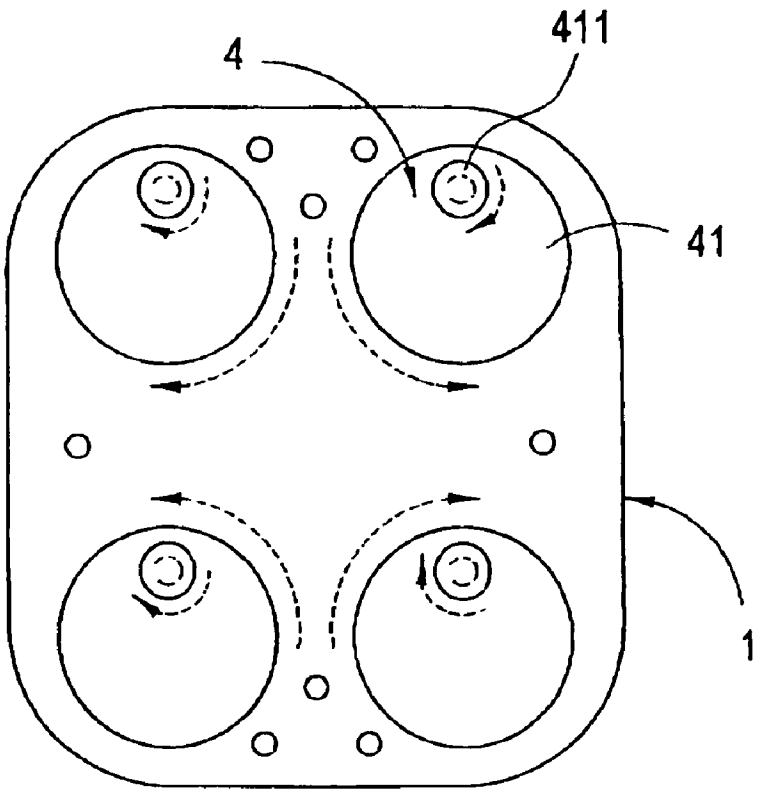
FIG. 3A and FIG. 3B are the schematic views illustrating how the kneading massager of the present invention operate.
Figure 3A:
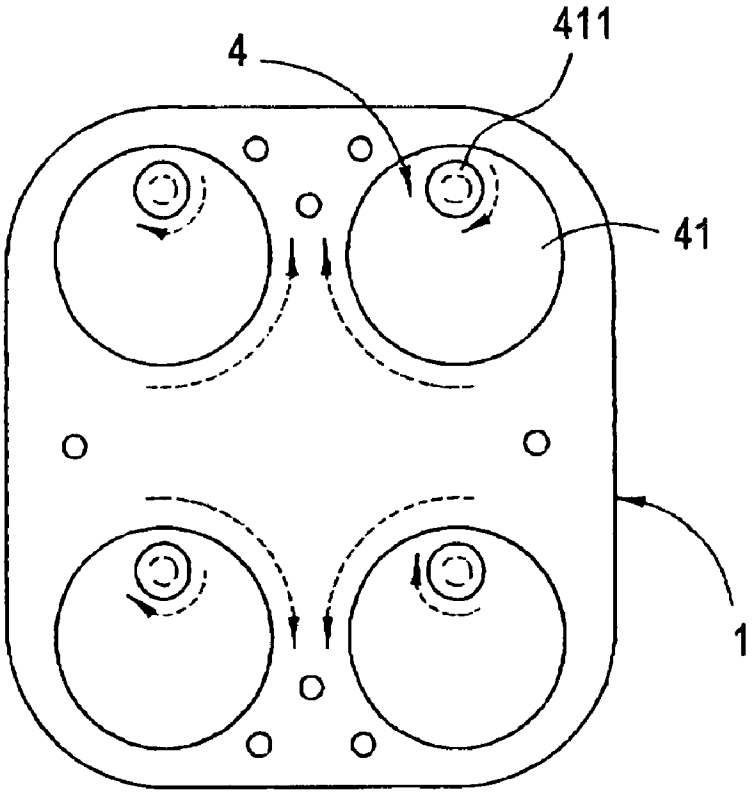

As shown in FIGS. 3A and 3B, the mechanical power of the rotating Dc motor 3 is transmitted to the massage block 4 to cause it perform a kneading motion inwardly or outwardly like human fingers. The mechanical power transmission route is Dc motor 3→worm gear 31→transmission gear 13→speed reduction gear unit 1→output shafts 251, 261, 271,281→massage block 4.

Figure 4A:
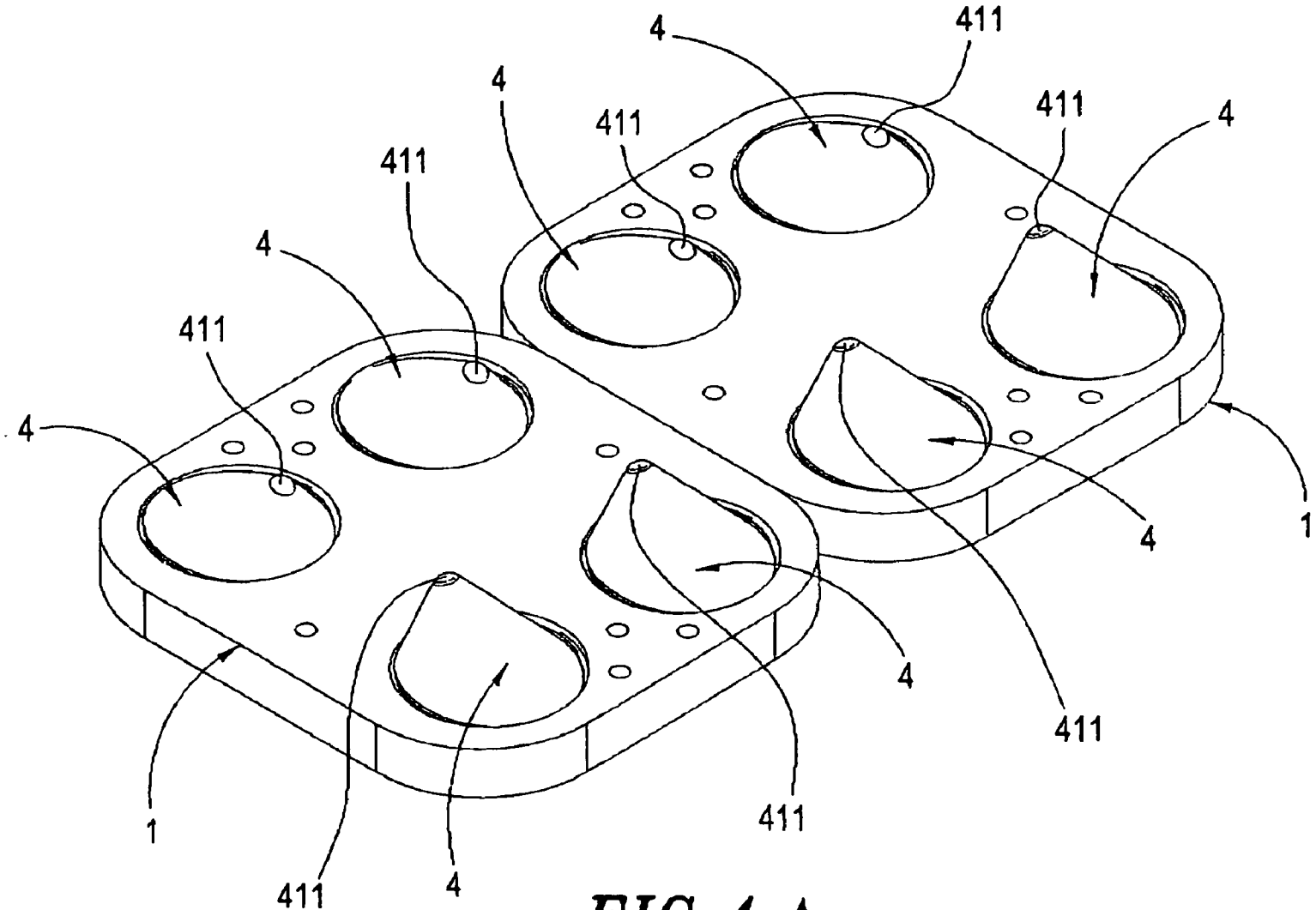
FIG. 4A is the three dimensional front view of the kneading massager in another embodiment.
Figure 4B:
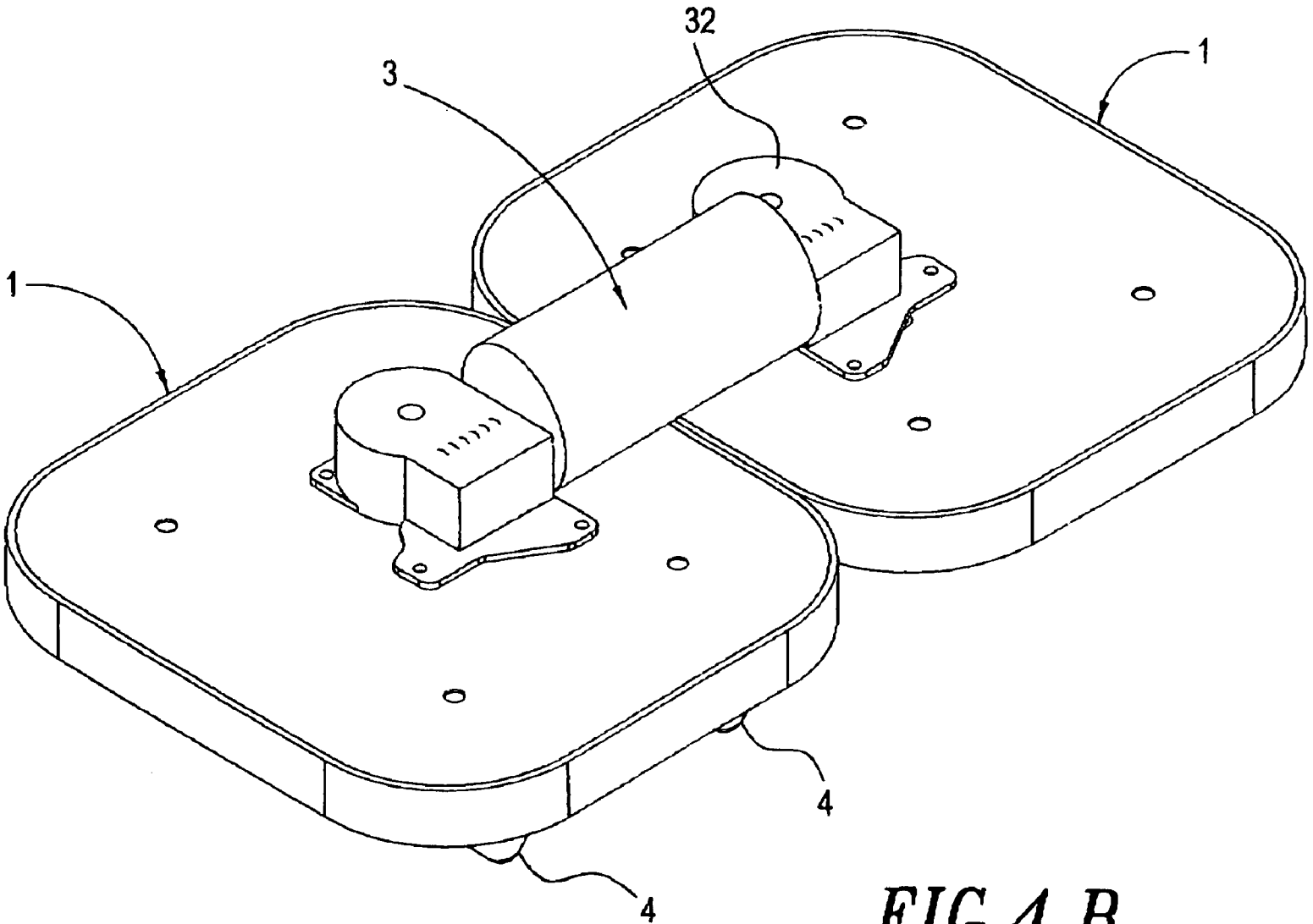
FIG. 4B is a back view of FIG. 4A.

Referring to FIGS. 4A and 4B, in this embodiments, an output shaft associated with the worm gear 31 and the bottom case 32 is provided to both ends of the Dc motor 3 so that both ends thereof can be equipped with a speed reduction gear unit 1 thereby widening the massage area. Of course more than two speed reduction gear units 1 can be used according to the practical need.

Figure 5:
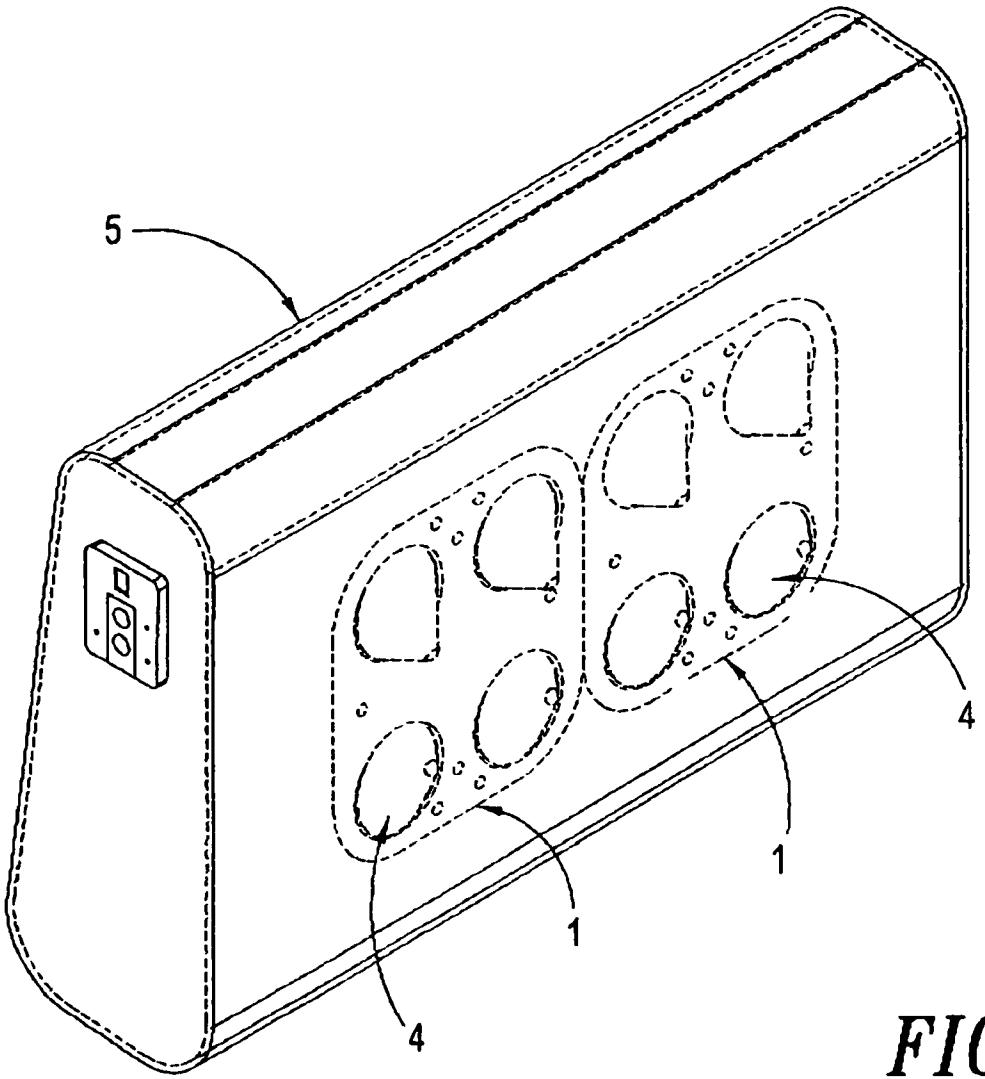
FIG. 5 is another schematic view illustrating how the kneading massager of the present invention operate.

As shown in FIG. 5, in operating the kneading massager of the present invention, the speed reduction gear unit 1 together with the conjoined Dc motor 3 and massage block 4 can be set in a massage chair, a massage bed, an automobile seat, an easy chair, an office chair or a massage cushion, through controlling the rotational direction of the DC motor 3 (right or reverse) with a control circuit so that the massage block 4 may make the kneading motion inwardly or outwardly on the user's body laid therein. If it is desirable, an extra movable block 411 may be added to the massage block 4 so as to move along with the latter. In this manner, the effect of eliminating muscle ache and relaxation of fatigue feeling can be more improved.

It emerges from the above description that the kneading massager of the present invention has several noteworthy advantages compared to the existing conventional massaging devices, namely:

1. The kneading motion of the massage block driven by the small DC motor brings a tender and comfortable feeling to the user.
2. The kneading massager of the present invention is light and compact in-size, so it can be fabricated and assembled with a very low cost, and is widely applicable for installing in a massage bed, a massage chair, an automobile seat, an easy chair, an office chair or a massage cusion.
3. The kneading massager of the present invention can be placed in a stationary location for use, or conveniently held in hand.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A kneading massager comprising:

a speed reduction gear unit;

a direct current (DC) driving motor;

a massage block, wherein said speed reduction gear unit is in mesh with a transmission gear at its bottom for inputting a mechanical power to said unit;

several output shafts are emerged out of a top surface of said speed reduction gear unit, wherein each output shaft is fitted with a metal washer disposed on the top surface of said speed reduction gear unit, said DC driving motor is coupled to a worm gear having a motor output shaft, said DC driving motor is disposed beneath said speed reduction gear unit such that the said worm gear can be in mesh with said transmission gear at the bottom of said speed reduction gear unit; and said massage block further includes a main body and a bottom cover, said main body has a hole at its bottom, wherein said bottom cover is provided with several confinement holes around its edge, and each confinement hole has a ball in it, said bottom cover is engaged to the bottom of said main body with its center hole aligned to the bottom hole of said main body and a metal pad is sandwiched therebetween such that said balls arrayed around the edge of said bottom cover are in contact with said metal pad, said balls are easily rotatable by mating with said metal washers disposed on the top surface of said speed reduction gear unit and thus facilitate motion of said massage block when said massage block is engaged with the output shaft of said speed reduction gear unit;

whereby when said DC driving motor rotates, the mechanical power is transmitted to said massage block via said worm gear coupled to said motor output shaft, to said transmission gear, then to said speed reduction gear unit such that said massage block is driven by the output shaft of said speed reduction gear unit to perform inwardly or outwardly kneading motion like human fingers.

2. The kneading massager as in claim 1, wherein said massage block has an extra movable block attached to its top end for improving the massage effect.

* * * * *